United States Patent [19]

Meyer

[11] 4,040,281

[45] Aug. 9, 1977

[54] PULLEY SPLITTING MACHINE-CONTROL SYSTEM

[75] Inventor: Bengt E. Meyer, Chardon, Ohio

[73] Assignee: Eaton Corporation, Cleveland, Ohio

[21] Appl. No.: 741,915

[22] Filed: Nov. 15, 1976

Related U.S. Application Data

[63] Continuation of Ser. No. 679,261, April 22, 1976, abandoned.

[51] Int. Cl.[2] ..... B21B 37/00; B21D 22/14

[52] U.S. Cl. ..... 72/10; 29/159 R; 72/82; 72/91; 113/116 D

[58] Field of Search ..... 72/80, 82, 83, 10, 91, 72/249; 113/116 D; 29/159 R, 159.2, 159.3

[56] References Cited

U.S. PATENT DOCUMENTS

| | | | |
|---|---|---|---|
| 1,828,464 | 10/1931 | Harrison | 72/82 |
| 3,087,531 | 4/1963 | Pacak | 72/83 |
| 3,566,503 | 3/1971 | Pacak | 29/159 R |
| 3,700,382 | 10/1972 | Pacak | 72/83 |
| 3,823,591 | 7/1974 | Schroder et al. | 72/83 X |
| 3,828,619 | 8/1974 | Frost et al. | 29/159 R X |
| 3,831,414 | 8/1974 | Haswell | 29/159 R |
| 3,893,818 | 7/1975 | Mickus | 29/159 R |

*Primary Examiner*—Leon Gilden
*Attorney, Agent, or Firm*—Teagno & Toddy

[57] ABSTRACT

An apparatus for manufacturing split pulleys includes a frame and a spindle assembly supported by the frame having an upper spindle and a lower spindle assembly for supporting for rotation a blank to be split therebetween. The lower spindle assembly includes a clamping mechanism having a screw means for drawing the upper spindle toward the lower spindle assembly and the lower spindle assembly toward the upper spindle to clamp the blank to be split therebetween. Bearing means are disposed between the frame and the spindle assembly for supporting the spindle assembly for rotation. The clamping means are operative to exert a clamping force between the upper spindle and the lower spindle assembly which is isolated from the frame and the bearing means to clamp a blank therebetween. A pair of rotatable tools are provided each of which has an axis of rotation parallel to the axis of rotation of the spindle assembly and each of which is associated with a motor means to effect rotation of the tools. The tools are operable to move relative to the blank supported by the spindle assembly to effect sequential engagement between the tools and the peripheral edge of the blank to sequentially split and form the blank. Control means is provided for controlling the speed of the spindle assembly to match the peripheral speed of the rotating blank supported by the spindle assembly with the peripheral speed of the tool with which it is desired to engage the blank. The control means senses the peripheral speed of the first tool to be engaged with the rotating blank and controls the speed of the spindle assembly in response to the peripheral speed of the first tool and subsequently senses the peripheral speed of the second tool to be engaged with the blank and subsequently controls the speed of the spindle assembly in response to the peripheral speed of the second tool. The speed control of the peripheral speed of the tools and the rotating blank matches the peripheral speed of the tools with the peripheral speed of the rotating blank to prevent skidding of the tools upon initial engagement of the tool with the blank.

13 Claims, 4 Drawing Figures

PULLEY SPLITTING MACHINE-CONTROL SYSTEM

This is a continuation of application Ser. No. 679,261, filed Apr. 22, 1976, now abandoned.

BACKGROUND OF THE INVENTION

The present invention relates to an apparatus for manufacturing split pulleys and more particularly to an apparatus for manufacturing split pulleys wherein a rotating blank is sequentially engaged with rotating tools to split and form the blank into a pulley and wherein the peripheral speed of the blank and the tools is matched upon initial engagement therebetween to prevent skidding of the tools relative to the blank.

Apparatus for manufacturing pulleys is exemplified by the Haswell et al. U.S. Pat. No. 3,831,414 and the Pacak U.S. Pat. No. 3,087,531 which is specifically directed to apparatus for manufacturing split pulleys. In the known apparatus the peripheral speed of the blank supported by the spindle is not matched with the peripheral speed of the tools which engage with the peripheral edge of the rotating blank. Hence, initial engagement between the tools and the rotating blank causes skidding of the peripheral surface of the rotating blank relative to the peripheral surface of the tool engaged therewith. This skidding causes undesirable wear characteristics on the tool and premature failure thereof.

SUMMARY OF THE INVENTION

The present invention provides a new and improved apparatus for manufacturing split pulleys including a spindle rotatably supporting a blank to be split, a first motor means for effecting rotation of the spindle and first and second rotatable tools disposed adjacent to the spindle and having an axis of rotation parallel to the axis of rotation of the tools. The tools are movable relative to the spindle for effecting engagement of the tools with the peripheral edge of a blank supported by the spindle. Second and third motor means are provided for effecting rotation of the first and second tools, respectively. First and second sensing means are provided for establishing first and second signals, respectively, indicative of the speed of rotation of the first and second tools. The first and second signals are directed to a control means for controlling the energization of the first motor to control the speed of the spindle to match the peripheral speed of a blank supported by the spindle with the peripheral speed of the first tool during initial engagement of the first tool with the rotating blank and to match the peripheral speed of the blank with the peripheral speed of the second tool during initial engagement of the second tool with the rotating blank.

The present invention provides new and improved apparatus for manufacturing split pulleys as set forth in the next preceding paragraph further including an encoder for establishing signals having first and second states. The encoder when establishing said signal having said first state conditioning the control means to be responsive to the first sensing means and nonresponsive to the second sensing means to control the speed of the spindle to set the peripheral speed of the rotating blank to be substantially equal to the peripheral speed of the first tool. The encoder when establishing the signal having the second state conditioning the control means to be responsive to the second sensing means and nonresponsive to the first sensing means to control the speed of the spindle to set the peripheral speed of the rotating blank substantially equal to the peripheral speed of the second tool.

The present invention further provides a new and improved apparatus for manufacturing split pulleys including a spindle for supporting a blank to be split, a first motor connected with the spindle for effecting rotation thereof, a splitting tool rotatably disposed adjacent the spindle and movable relative thereto for effecting engagement of the splitting tool with the peripheral edge of the blank supported by the spindle and a forming tool rotatably disposed adjacent the spindle and being movable relative to the spindle for effecting engagement of the forming tool with the peripheral edge of the blank. A second motor is provided for effecting rotation of the splitting tool prior to engagement therewith with the peripheral edge of the blank and a third motor is provided for effecting rotation of the forming tool prior to engagement therewith with the peripheral edge of the blank. A control means is provided for controlling the energization of the first motor to control the speed of the spindle to match the peripheral speed of the blank supported by the spindle with the peripheral speed of the splitting tool during initial engagement of the splitting tool with the rotating blank and further controlling the energization of the first motor to control the speed of the spindle to match the peripheral speed of the blank supported by the spindle with the peripheral speed of the forming tool during initial engagement of the forming tool with the rotating blank.

DESCRIPTION OF THE PREFERRED EMBODIMENT

Figure 1:
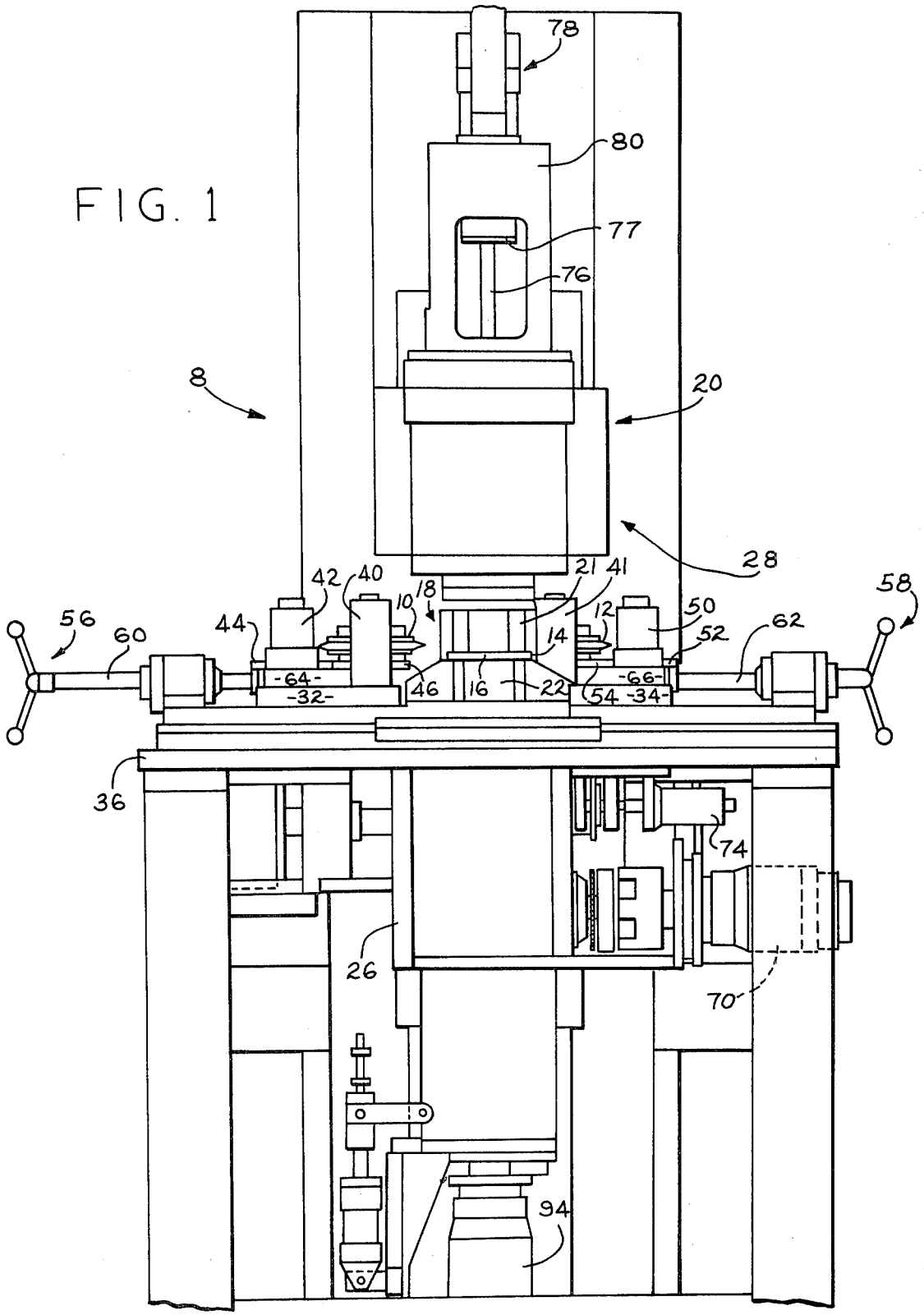
FIG. 1 is a front view of the apparatus for manufacturing split pulleys.
Figure 2:
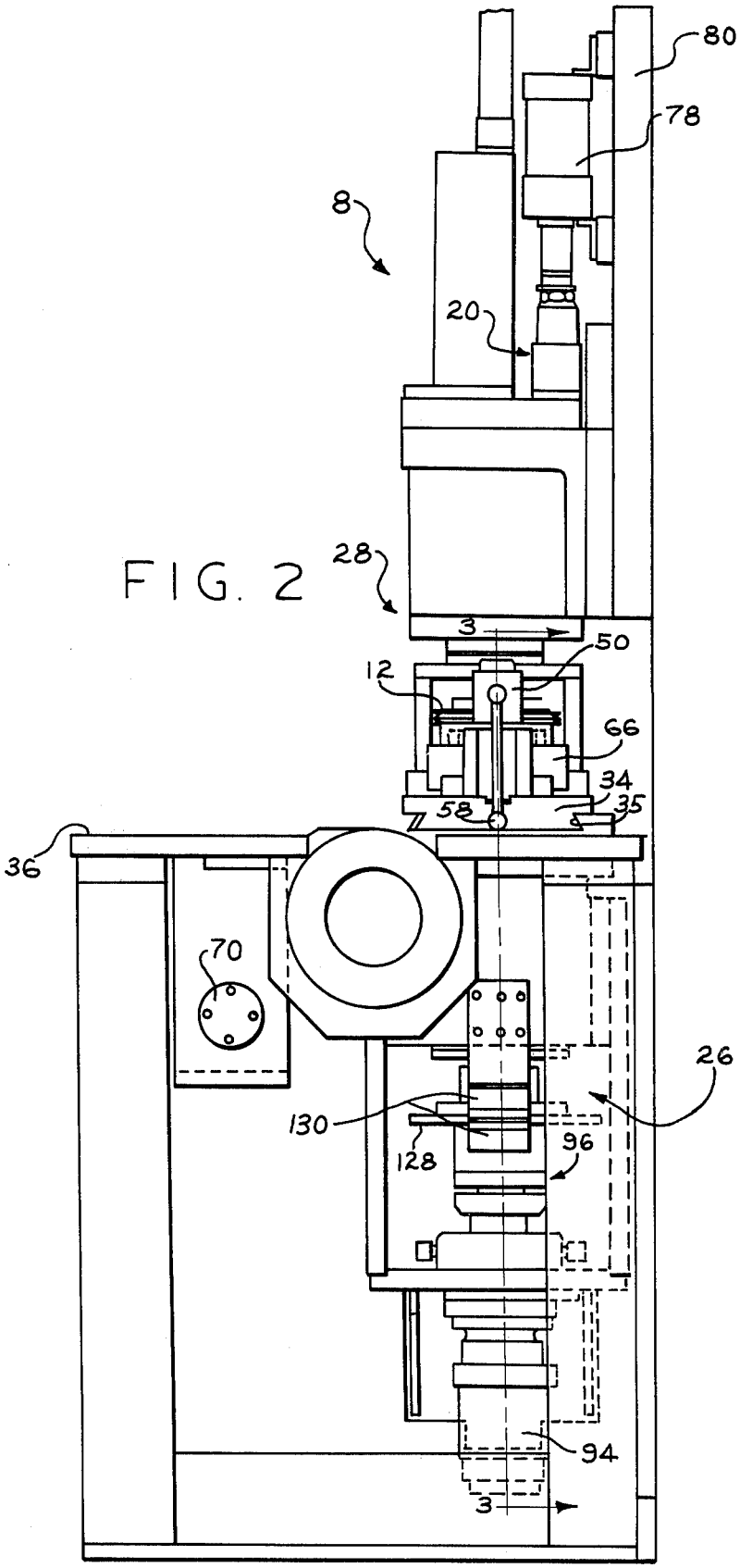
FIG. 2 is a side view of the apparatus illustrated in FIG. 1.

Referring to FIGS. 1 and 2 the present invention involves the use of a pulley splitting apparatus 8 which utilizes splitting and forming tool means for producing peripherally grooved wheels by engaging the tool means with the edge portion of a metal blank so as to split and form such edge portion into a grooved rim. The tool means comprise a splitting roller 10 and a forming roller 12 which are successively brought into operative engagement with the edge portion or periphery 14 of a disc shaped metal blank 16 for splitting such edge portion and shaping the same into a grooved rim, while the blank is being held and rotated by a workholder means 18.

A spindle assembly 28 is provided for supporting and rotating the blank 16. The spindle assembly 28 includes an upper spindle 20 and a lower spindle assembly 26 which respectively support an upper die 21 and a lower die 22 of the workholder means 18. The upper and lower dies 21 and 22, respectively, can be clamped together by a clamping mechanism 30 which will be more fully described hereinbelow to rigidly support the metal blank 16 for rotation by the spindle assembly 28.

The splitting and forming tools 10, 12 are supported on the cross-slide members 32 and 34, respectively, for movement in an horizontal direction toward and away from a workpiece 16 supported by the spindle assembly 28. The cross-slide members 32 and 34 are supported on the table 36 of the machine 8. A guideway 35, more fully illustrated in FIG. 2, is disposed on the table 36 for guiding horizontal movement of the cross slide 34. A similar guideway, not illustrated, is disposed on the table 36 to guide the horizontal movement of the cross slide 32.

Affixed to the cross slide 32 for movement therewith is a support member 40 which supports the splitting tool 10 for rotation on the cross slide 32. Also, supported on cross slide 32 is a hydraulic motor 42 which is operable to effect rotation of the splitting tool 10 to prevent skidding of the tool 10 when it initially engages with the peripheral edge portion 14 of the blank 16 as will be more fully described hereinbelow. To this end the hydraulic motor 42 effects rotation of a planetary gear 44 which meshes with a planetary gear 46 supported by the support member 40. Planetary gear 46 is connected to rotate with the tool 10 by a shaft (not illustrated). Thus, energization of the hydraulic motor 42 effects rotation of the gears 44 and 46 which in turn effects rotation of the splitting tool 10.

Affixed to the cross slide 34 is the support member 41 which supports the forming tool 12 for rotation on the cross slide 34. A hydraulic motor 50 is similarly mounted on the cross slide 34. The hydraulic motor 50 effects rotation of a planetary gear 52 attached thereto which is engaged with a planetary gear 54. The planetary gear 54 is attached to the forming tool 12 by a suitable shaft, not illustrated, to effect rotation thereof. Thus, energization of the hydraulic motor 50 effects rotation of the gears 52 and 54 to thereby rotate the forming tool 12.

Manual adjustment means 56 and 58 are provided to effect vertical adjustment of the tools 10 and 12, respectively, with respect to the table 36 upon which the cross slides 32 and 34 are mounted. To this end the adjustment means 56 and 58 includes rotatable shafts 60 and 62, respectively, which are operable to be rotated to effect linear movement of carrier blocks 64 and 66 relative to the slide members 32 and 34, respectively. The carrier blocks 64 and 66 support the hydraulic motors 42 and 50 and the support means 40, 41 for the tools 10 and 12, respectively, on the cross slides 32 and 34. An inclined block arrangement, not illustrated, is utilized to effect vertical movement of the tools 10, 12, the support members 40, 41 and the hydraulic motors 42, 50 upon linear movement of the support blocks 64 and 66 relative to the cross slides 32, 34. The inclined block arrangement is a well known mechanism for transforming the linear motion imparted thereto by the adjustment means into vertical movement of the carrier blocks. To this end the inclined block arrangement includes complementary inclined planes which when moved horizontally relative to each other effect relative vertical movement of the parallel horizontal surfaces of the inclined planes. Thus, rotation of the shafts 60 and 62 will effect vertical movement of the tools 10, 12 relative to the workpiece 16 to thereby provide for a machine which is adapted to operate on various workpieces with various tools.

Hydraulic motor means are provided to effect movement of the cross slides 32 and 34 toward the axis of rotation of the spindle assembly 28 to effect sequential engagement of the tools 10 and 12 with the peripheral edge portion of the workpiece 16. To this end, a hydraulic motor 70 is mounted on the frame of the machine 8. The hydraulic motor 70 effects rotation of a pair of cam drums, not illustrated, which are connected to the cross slide members 32 and 34 in a well known manner. The drums which rotate in response to energization of the motor 70 include a plurality of cam tracks therein which are adapted to receive associated cams to control the horizontal movement of the cross slides across the table 36 and hence, the engagement of the tools 10 and 12 with the blank 16.

An encoder 74 is connected to the cam drum drive motor 70 to sense the point of operation of the machine 8 during any individual machine cycle. The encoder establishes an output signal indicative of the position in the machine cycle and which will be utilized as more fully described hereinafter.

In a preferred operation of the present apparatus the cam drums will be configured to enable the splitting tool 10 to first be moved into engagement with the peripheral edge portion 14 of the blank 16. After initial splitting is completed by the tool 10, the forming tool 12 will then move into contact with the blank 16. Penetration of the forming tool 12 will form the groove in the blank 16 established by the splitting tool 10. The forming tool 12 will operate to round the bottom of the groove and provide beads on the external edges of the groove if so desired. A further explanation as to the operation of the tools on the blank can be had with reference to the Pacak U.S. Pat. No. 3,087,531 entitled "Apparatus for Making Grooved Wheels."

Figure 3:
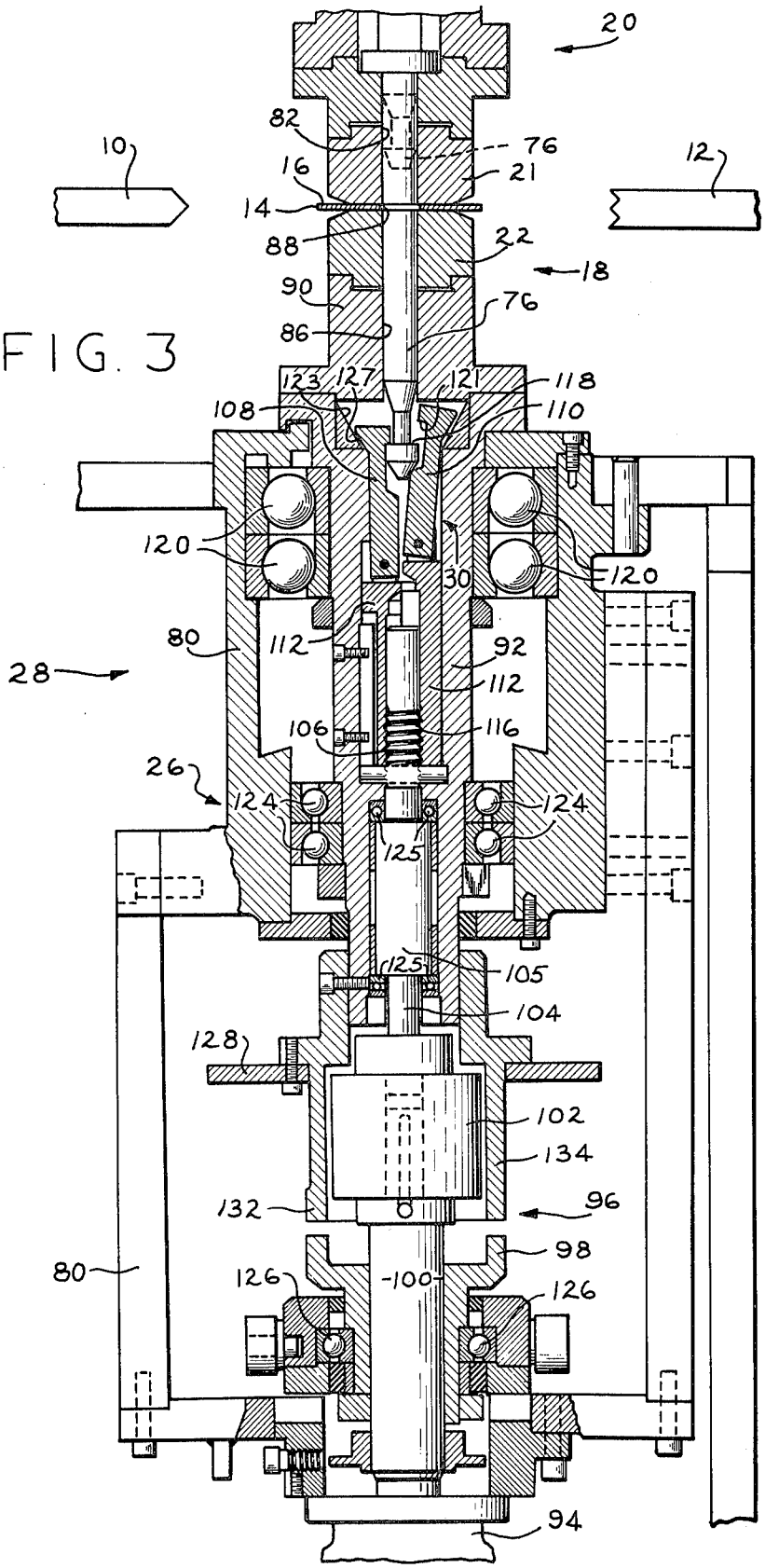
FIG. 3 is an enlarged cross-sectional view of the spindle assembly taken approximately along lines 3—3 of FIG. 2 more fully illustrating the clamping mechanism.

The spindle assembly 28 and the clamping mechanism 30 disposed in the lower spindle assembly 26 is more fully illustrated in FIG. 3. The upper spindle 20 supports the upper die 21 and is movable in a vertically upward direction from its position illustrated in FIG. 3 to enable a blank 16 to be positioned between the upper and lower dies 21, 22. To this end, an upper die cylinder 78 is mounted on the frame 80 of the machine, as is more fully illustrated in FIGS. 1 and 2, for effecting vertical movement of the upper spindle assembly 20.

A locating pin 76 is vertically slidable within a bore 82 disposed in the upper spindle 20 and in the bore 86 disposed in the lower spindle assembly 26 and which is coaxial with the bore 82. The locating pin 76 is operable to move from its retracted or uppermost vertical position illustrated in phantom lines in FIG. 3 to its extended or lowermost vertical position illustrated in full lines in FIG. 3. Each of the blanks 16 which is secured between the die members 21, 22 includes a centrally located opening 88 therein. When the locating pin 76 is in its extended position, it extends through the central opening 88 disposed in the blank 16 to locate and center the blank 16 between the upper and lower dies, 21, 22 prior to clamping of the blank therein. When the locating pin 76 is in its retractive position, as is illustrated in phantom lines in FIG. 3, a blank may be inserted or removed from between the die members 21, 22. A suitable fluid cylinder, not illustrated, can be utilized to raise and lower the locating pin 76.

The lower die member 22 is supported in a die adapter 90 which is supported on the lower spindle assembly 26 for rotation therewith. The lower spindle assembly 26 includes a substantially tubular lower spindle member 92 which may be rotated by a hydraulic motor 94 suitably connected thereto via a clutch 96. A shaft member 100, which is disposed coaxial to the axis of rotation of clutch 96, is connected through a torque tender 102 to the inner spindle shaft 104. The shaft 104 supports a torque screw 106 at one end thereof. Rotation of the shaft 100 by the motor 94 will effect rotation of the torque screw 106 via the torque tender 102 and the shaft 104 to thereby actuate the clamping mechanism 30 as will be more fully described hereinbelow.

The clutch 96 disposed between the fluid motor 94 and the lower spindle member 92 is selectively energizable to effect either rotation of the torque screw 106 relative to the lower spindle member 92 or synchronous rotation of the torque screw 106 and the lower spindle member 92. The clutch 96 includes a driving member 98 which is continuously connected to the output of the hydraulic motor 94 for rotation with the shaft member 100. When the clutch 96 is energized the driving member 98 of the clutch 96 engages with the teeth 132 of the driven member 134 of clutch 96 to effect rotation of the driven member 134 and the lower spindle member 92 which is connected thereto. A braking disc 128 is attached to the lower spindle member 92 to fix the lower spindle member 92 relative to the frame when the clutch 96 is deenergized and it is desired to rotate only the torque screw 106. A brake mechanism 130, schematically illustrated in FIG. 2, is provided for braking the disc 128 to thereby brake the lower spindle member 92.

The torque screw 106 is fixed vertically in the lower spindle assembly 26. Disposed contiguous to the threaded end of the torque screw 106 is a threaded finger holder 112 which is illustrated in FIG. 3 in two positions. The finger holder 112 is carried by the lower spindle member 92 for rotation therewith and is illustrated in its unclamped position on the right side of FIG. 3 and in its clamped position on the left side of FIG. 3 as will be more fully explained hereinafter. The finger holder 112 includes threaded portions 116 which engage with the threaded portion of the torque screw 106. Rotation of the torque screw 106 when the lower spindle member 92 is fixed from rotation will effect relative rotational movement between the finger holder 112 and the torque screw 106. The relative rotational movement of the finger holder 112 and the torque screw 106 will effect relative vertical movement of the finger holder 112, due to the engagement of the threaded portions 116 thereof with the threaded portion of the torque screw 106.

Pivotably attached to the finger holder 112 are the finger members 108 and 110. The finger members 108 and 110 are operable to rotate with the lower spindle member 92 and move vertically with the finger holder 112. The finger members 108 and 110 are adapted to pivot into engagement with the locating pin 76 to exert a downward clamping force on the locating pin 76 to clamp a blank between the upper and lower dies 21, 22 if the locating pin is in its downwardmost position as illustrated in full lines in FIG. 3. The locating pin 76 includes a shoulder portion 118 which is adapted to engage with the shoulder portions 121 disposed on the locating fingers 108 and 110. The lower spindle 92 includes the inclined surface 123 which engages with the complementary inclined surface 127 located on the exterior of the finger members 108, 110. Upon initial vertical movement of the finger members 108, 110 in a downwardly direction from the position of finger member 110 to the position of finger member 108, due to the movement of the finger holder 112 from its position shown on the right side of the locating pin 76 in FIG. 3 to its position shown on the left side of locating pin 76 the inclined surface 123 will engage with the inclined exterior surface 127 of the finger members to direct the finger member inwardly from the position of finger member 110 to the position of finger member 108 to effect engagement of the fingers with locating pin 76. After initial engagement of the finger members 108, 110 with the locating pin 76 further rotation of the torque screw 106 relative to the finger holder 112 will cause further downward movement of the fingers 108, 110. This further downward movement of the fingers 108, 110 will draw the locating pin 76 in a downwardly direction to thereby draw the upper die member 21 into engagement with the lower die member 22. It should be apparent that when the locating pin 76 is clamped in place by the finger members 108, 110 a positive clamping force will be established between the upper and lower die members 21, 22 to clamp a blank 16 therebetween. This clamping force will not be relieved or decrease until the torque screw 106 is rotated in an unclamping direction to effect disengagement of the finger members 108, 110 from the locating pin 76. A torque tender 102 is disposed between the hydraulic motor 94 and the torque screw 106 to limit the amount of torque and thus the clamping force exerted on the blank 16. The torque tender 102 operates in a well known manner.

The spindle assembly 28 is supported for rotation relative to the frame 80 by a plurality of main bearings 120. The main bearings 120 are disposed between the lower spindle member 92 and the frame 80 of the machine 8. The bearings 120 support the upper spindle 20 and the lower spindle member 92 for rotation relative to the frame 80 of the machine. The bearings 120 support the weight of the spindle assembly 28 thereon and are also subjected to a radial load established by reaction forces generated upon engagement of the tools 10, 12 with the peripheral edge of the blank 16.

Bearing members 124 are disposed between the frame 80 and the lower portion of the lower spindle member 92. The bearings 124 center the lower portion of the lower spindle member 92 relative to the frame 80 while supporting the spindle 92 for rotation. As such, the bearings 124 do not support a major portion of the weight of the spindle assembly 28. A further set of bearing members 126 is provided to support the lower spindle assembly 26 for rotation. The bearing members 126 are disposed between the input member of the clutch 96 and the frame 80. The bearings 126 do not play a major role in supporting the spindle 26 but rather act to center the spindle for rotation relative to the frame 80. A plurality of bearings 125 engage with an enlarged portion 105 of the inner spindle shaft 104 to support the inner spindle shaft 104 for rotation relative to the lower spindle member 92. The bearings 125 engage with the end surfaces of the enlarged portion 105 of the inner spindle shaft 104 to transfer vertical reaction forces established during clamping of workpiece 16 from the torque screw 106 and the inner spindle shaft 104 to the lower spindle member 92.

After a blank 16 is initially located between the dies 21, 22 by a suitable loading mechanism, the blank will be clamped prior to rotation thereof. To effect clamping of a blank 16 between the disc 21, 22 the clutch 96 will be in its de-energized position illustrated in FIG. 3 and the brake 130 will be energized to engage the disc 128 and prevent rotation of the lower spindle member 92. The hydraulic motor 94 will then be energized to effect rotation of the inner spindle shaft 104 and the torque screw 106 relative to the fixed lower spindle member 92 and the finger holder 112 affixed thereto. Rotation of the torque screw 106 relative to the finger holder 112 will draw the fingers 108 and 110 in a downwardly direction to effect engagement thereof with the locating pin 76 to clamp a workpiece 16 between the upper and lower die members 21, 22. After the workpiece has been clamped and the brake 130 disengaged, the clutch 96 will be energized to effect engagement of the input member 98 with the teeth 132 of the output clutch member 134 to couple the spindle member 92 to the hydraulic motor 94 for rotation therewith. Thus, when the cluth 96 is energized the lower spindle member 92 and the torque screw 106 will rotate synchronously upon energization of the motor 94. Rotation of the spindle member 92 and the torque screw 106 will effect rotation of the whole spindle assembly 28 and the blank 16 clamped therein to enable the blank to be split upon engagement thereof with the splitting and forming tools 10, 12. Since the torque screw 106 is not rotating relative to the finger holder 112 synchronous rotation of the spindle member 92 and the torque screw 106 will not effect further clamping of a workpiece 16 by further drawing the fingers 108 and 110 in a downwardly direction.

It should be apparent that the location of the main spindle bearings 120 disposed between the outer spindle member 92 and the frame 80 enables the bearings 120 to support substantially the entire weight of the spindle assembly 28 while being substantially isolated from the clamping force established between the upper and lower dies 21 and 22 by the torque screw 106. Upon clamping, as discussed hereinabove, the torque screw 106 exerts a downward force on the locating pin 76 which includes a shoulder 118 thereon which exerts a force on the upper spindle 24 to pull the upper die 21 in a downwardly direction. The downward force exerted on the locating pin 76 also establishes an upward reactionary force on the fingers 108, 110 and the finger holder 112. The engaged threads on the torque screw 106 and the threads 116 on the finger holder 112 transfers the reactionary upward force from the finger holder to the torque screw 106 and from the torque screw 106 through the bearings 125 to the lower spindle member 92. The upward force exerted on the lower spindle member 92 is transferred through the die adapter 90 to the lower die 22 to thereby exert an equal and opposite clamping force on the blank 16 as exerted by the upper die 21. In this manner a clamping force is established between the upper and lower dies 21 and 22 which is approximately equal to 15,000 lbs. which clamping force is sufficient to secure the blank rigidly between the upper and lower dies 21 and 22 to prevent the blank from moving relative to the dies when the blank is split and formed.

The main spindle bearings 120 are substantially isolated from the clamping force established between the upper and lower dies 21, 22 by operation of the clamping mechanism 30 due to the fact that the clamping mechanism 30 is wholly supported by the spindle assembly 28. This is a great advantage over known clamping arrangments for pulley splitting machines wherein the clamping force is exerted on the main spindle bearings due to the fact that the clamping force is developed between the spindle assembly and the frame of the machine. It can be seen by relieving 15,000 lbs. of force from the bearings 120 that their life will be substantially expanded. The weight of the spindle assembly 28 is between 700 and 800 lbs. depending on the dies for holding the workpiece. Thus, the bearings 120 are only subjected to a vertical force equal to the weight of the spindle which is approximately equal to 5% of the clamping force established by the torque screw. Thus, by isolating the clamping force from the bearings 120, the bearings are only subjected to 700–800 lbs. force in a vertical direction versus over 15,000 lbs. of force if the clamping forces were not isolated from the bearings.

The bearings 120 and the bearings 124 are also subjected to a radial force caused by engagement of the tools 10, 12 with the workpiece 16. To this end the splitting tool is operable to exert a 2,000 lbs. force in a radial direction on the blank 16 and the spindle assembly 28 when the splitting tool engages with the periphery 14 thereof. When the forming tool 12 engages with the periphery 14 of the workpiece 16 to form the groove, the forming tool 12 is operable to exert a radial force of up to 6,000 lbs. against the blank 16 and the spindle assembly 28. These radial forces are transferred in part to the bearings 120 and 124. The bearings 120 have the majority of the radial force applied thereto while the bearings 124 may support up to approximately 3,000 lbs. force in a radial direction. Thus, it can be seen that the bearing arrangement provides for isolation of the clamping force from the main spindle bearings 120 and the secondary spindle bearings 124. This, of course, will increase the life of the spindle bearings.

Figure 4:
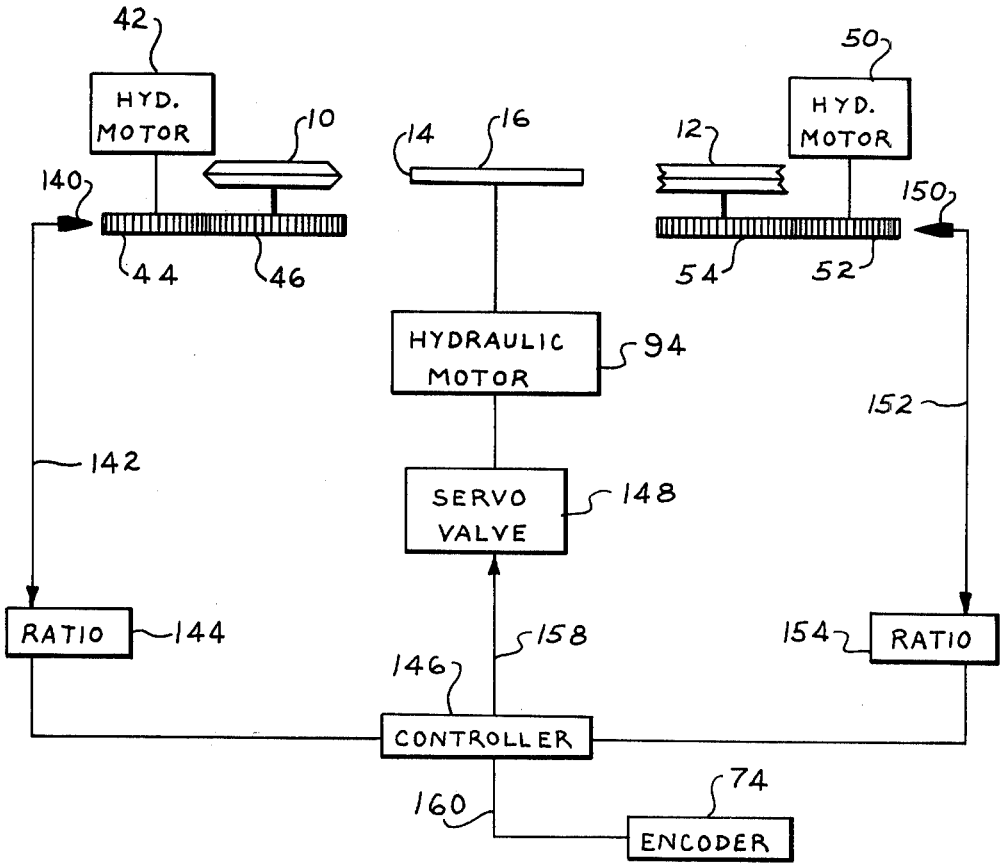
FIG. 4 is a schematic illustration of the control system for synchronizing the spindle and the rotating tools.

It is desirable to match the surface speed of the peripheral portion 14 of the blank 16 with the surface speed of the tools 10 and 12 upon initial engagement therebetween. Matching the surface speed of the tools 10, 12 with the surface speed of the peripheral edge 14 of the blank 16 will prevent skidding of the tools and premature wear thereof upon initial engagement of the tools with the blank 16. To this end, a control system, more fully illustrated in FIG. 4 is provided for matching the surface speed of the blank 16 with the surface speed of the tools 10, 12.

A sensor 140 is provided adjacent the gear 46 which drives the tool 10 in response to energization of the hydraulic motor 42 and rotation of the gear 44. The sensor 140 establishes a signal on line 142 which is indicative of the linear or surface velocity of the gear 46. The signal on line 142 is directed through a ratio control 144 to a master controller 146. The master controller 146 establishes a signal on line 158 which controls a servo value 148 to thereby control the fluid flow to the hydraulic motor 94 and thus, control the rotational velocity of the spindle assembly 28 and the blank 16 supported therein.

The ratio control 144 is provided to scale the signal on line 142 before it is directed to the controller 146. The ratio control is programmed to take into account the relative diameter of the tool 10 and the blank 16 to scale the signal from sensor 140 to enable the controller 146 and servo valve 148 to match the surface speed of the blank 16 with the surface speed of the tool 10 for tools and blanks of various diameters. The signal on line 142, which is directed to the ratio control 144, is indicative of the surface velocity of gear 46 while the signal on line 142, as modified by the ratio control 144, is indicative of the surfce velocity of the tool 10 when taking into account the relative diameters of the tool 10 and the blank 16. This enables the present machine to be used with various size tools and blanks wherein the surface velocities will vary over a wide range compared to the surface velocity of the gear 46 which is sensed by the sensor 140.

A sensor 150 is provided adjacent the gear 54 which drives the forming tool 12. The sensor 150 establishes a signal on line 152 indicative of the surface velocity of the gear 54 which rotates with the tool 12. A ratio controller 154 scales the signal on line 152 so that it is indicative of the surface speed of the forming tool 12 in a manner analogous to that discussed with respect to the ratio controller 154. The ratio control 154 then directs the signal which is now indicative of the surface speed of the forming tool 12 to the controller 146. The controller then establishes a signal on line 158 to bias the servo valve 148 to control the fluid flow to the hydraulic motor 94 to match the speed of the blank 16 rotated by the hydraulic motor 94 with the surface speed of the forming tool 12.

The encoder 74 provides a signal on line 160 which sets the controller 146 to either be responsive to the signal on line 142 indicative of the surface speed of the splitting tool 10 or responsive to the signal on line 152 indicative of the surface speed of the forming tool 12. The encoder 74 senses the position of the machine as it goes through each cycle and provides an instantaneous signal indicative of the position in the machine cycle on line 160 to the controller 146. As discussed hereinabove the splitting tool 10 initially engages the blank 16 to split the peripheral edge 14 thereof. After the tool 10 has penetrated the blank 16, then the tool 12 engages with the blank 16 to form the groove. Thus, it is desired to initially set the surface speed of the blank 16 equal to that of the tool 10 upon initial engagement therebetween and then set the surface speed of the blank 16 equal to the surface speed of the forming tool 12 when the tool 12 subsequently engages with the peripheral edge 14 of the blank 16.

The encoder 74 establishes a signal on line 160 indicative of the machine position. To this end when the tool 10 moves toward initial engagement of the blank 16, the controller 146 is actuated by a signal on line 160 from the encoder 74 to direct the signal on line 142 to the servo valve 148 to thereby set the surface speed of the blank 16 equal to the surface speed of the tool 10. After the tool 10 makes initial engagement with the blank at a synchronous surface speed the hydraulic motor 42 will be deenergized to allow the tool 10 to coast. The tool 10 will then be driven by its engagement with the blank 16. This is important due to the fact that the speed of the surface of the blank 16, which engages with the splitting tool 10, will vary as the tool 10 penetrates the peripheral edge 14 of the blank. The blank 16 will be maintained at a substantially constant angular velocity once set by the surface speed of the splitting tool 10 but the decrease in radius caused by the penetration of the tool 10 into the blank 16 will cause an increase in the surface speed of the engaged surfaces of the blank 16 and the tool 10.

After the tool 10 has made engagement with the blank 16 the forming tool 12 can then be moved into engagement with the blank 16. However, the surface speed of the blank 16 must then be matched to the surface speed of the tool 12 which is driven by the hydraulic motor 50. The encoder 74 will then operate to establish a signal on line 160 to set the controller 146 to be responsive to the signal on line 152 rather than the signal on line 142. In this manner the hydraulic servo valve 148 and hydraulic motor 94 will be energized to match the surface speed of the blank 16 with the surface speed of the forming tool 12 subsequent to matching the surface speed of the blank 16 with the surface speed of the tool 10. After the tool 12 has made initial engagement with the blank 16 the motor 50 will be deenergized to allow the rotating blank 16 to drive the tool 12. Thus, the control system will function to control the surface speed of the blank 16 to match the surface speed of the tools 10 and 12 as the tools sequentially engage with the blank 16.

The operation of the machine will now be briefly described. The machine 8 will start in a position in which the locating pin 76 is raised to its phantom line position illustrated in FIG. 3 and the tools 10 and 12 are spaced from the upper and lower dies 21 and 22. Initial operation of the machine will effect location of a blank 16 between the dies 21 and 22. The locating pin 76 will then be moved in a downwardly direction through the opening 88 disposed in the blank 16 to center the blank between the dies 21 and 22. The upper die cylinder 78 will then be energized to move the upper die 21 in a downwardly direction as the locating pin 78 moves in a downwardly direction. The locating pin 76 will then be in position to be engaged by the fingers 108 and 110. After the locating pin 76 is moved down the inner spindle member 104 and the torque screw 106 will be rotated by the hydraulic motor 94 while the lower spindle member 92 is fixed from rotation by energization of the spindle brake 130 to thereby clamp a blank 16 between the die members 21, 22.

After the torque screw 106 has effected clamping of the blank between the dies 21, 22 the spindle clutch 96 will be energized and the spindle brake 130 deenergized. The hydraulic motor 94 will then effect rotation of the spindle assembly 28 including the lower spindle member 92 and the torque screw 106. When the spindle 28 starts to rotate the motor 42 will be energized to rotate the splitting tool 10. The cam drum drive 70 will then be energized to move the cross slide 32 inwardly toward the axis of rotation of the spindle 28 to effect engagement of the splitting tool 10 with the blank 16. At this time the sensor 140 will direct a signal to the controller 146 which will then set the speed of the spindle 28 so that the surface speed of the blank 16 matches the surface speed of the tool 10. Upon initial engagement of the tool 10 with the blank 16 the motor 42 will be deenergized and the tool 10 will be allowed to coast and rotate in response to the rotational forces exerted thereon due to engagement with the blank 16. The tool 12 will then be moved toward the axis of rotation of the spindle 28 to effect engagement of the forming tool 12 with the blank 16. As the tool 12 is moved toward the blank 16 the tool will be rotated by energization of hydraulic motor 50. After hydraulic motor 42 for driving tool 10 is deenergized the encoder 74 will direct a signal to the controller 146 to set the controller to be responsive to the signal on line 152 indicative of the speed of tool 12 rather than the signal on line 142. Thus, as the tool 12 moves toward the blank 16 the sensor 150 will direct a control signal via line 152 to the controller 146 to thereby set the speed of the spindle 28 and the surface speed of the blank 16 to match the surface speed of the tool 12. Upon initial engagement of the tool 12 with the blank 16, the motor 50 will be deenergized to allow the tool 12 to coast in response to the rotational forces exerted thereon by the blank 16. It should be appreciated that the operation of the splitting tool 10 and the forming tool 12 can be either simultaneous on the blank 16 or sequential. However, the control system should be operable to control the speed of the blank to maintain the surface speed of the blank 16 equal to the surface speed of the tools 10, 12 upon initial engagement therebetween. After the tools 10 and 12 have performed their work on the blank 16, the carriages 32 and 34, respectively, will move to draw the tools away from the blank 16. At this time the spindle clutch 96 will be disengaged and the spindle brake 130 engaged. After the spindle brake is engaged the hydraulic motor 94 will be reversed to unscrew the torque screw 106 to unclamp the formed blank 16. After the torque screw 106 and the fingers 108 and 110 release the locating pin 76, the locating pin will be retracted in an upwardly direction and the upper die 21 will be raised to enable the formed blank 16 to be removed and a new blank inserted in the dies.

While the present machine has been described as having a vertical spindle assembly with upper and lower spindles, it should be apparent that horizontal operation of the present device is also contemplated. Moreover, the position of the upper and lower spindles could be reversed without effecting the operation of the present device and it is desired to cover such modifications herein.

From the foregoing, it should be apparent that a new and improved machine has been provided for manufacturing split pulleys and other grooved articles. The machine provides for a unique bearing arrangement wherein the main spindle bearings support the spindle for rotation but are isolated from the clamping forces established upon clamping the blank between the upper and lower spindles. Moreover, a unique control system has been provided for matching the surface speed of a blank supported in the spindle with the surface speed of a plurality of tools as the tools sequentially engage with the peripheral edge of the rotating blank.

I claim:

1. An apparatus for manufacturing split pulleys comprising a spindle for rotatably supporting a blank to be split, first motor means connected with said spindle for effecting rotation of said spindle and a blank supported therein, a first rotatable tool disposed adjacent said spindle and having an axis of rotation parallel to the axis of rotation of said spindle, said first tool being movable relative to said spindle for effecting engagement of said first tool with the peripheral edge of a blank supported by said spindle, second motor means for effecting rotation of said first tool, a second rotatable tool disposed adjacent said spindle and having an axis of rotation parallel to the axis of rotation of said spindle, said second tool being movable relative to said spindle for effecting engagement of said second tool with the peripheral edge of a blank supported by said spindle, third motor means for effecting rotation of said second tool, first sensing means for establishing a first signal indicative of the speed of rotation of said first tool, second sensing means for establishing a second signal indicative of the speed of rotation of said second tool, and control means responsive to said first and second signals for controlling the energization of said first motor means to control the speed of said spindle, said control means controlling the speed of said spindle to match the peripheral speed of a blank supported by said spindle with the peripheral speed of the first tool during initial engagement of said first tool with the rotating blank, said control means further controlling the speed of said spindle to match the peripheral speed of a blank supported by said spindle with the peripheral speed of the second tool during initial engagement of said second tool with the rotating blank.

2. An apparatus for manufacturing split pulleys as defined in claim 1 wherein said apparatus operates in a cyclic fashion to effect manufacture of successive split pulleys and further including encoder means for sensing the instantaneous position in the cycle of operation of the apparatus for establishing an encoder signal indicative of the instantaneous position of operation in the cycle of the apparatus and wherein said encoder signal controls said control means to determine whether the spindle speed should be controlled to match the peripheral speed of a blank rotated by the spindle with the peripheral speed of the first tool or the peripheral speed of the second tool depending upon the instantaneous position in the cycle of operation of the apparatus.

3. An apparatus for manufacturing split pulleys as defined in claim 1 further including an encoder means for establishing an encoder signal having first and second states, said encoder means when establishing an encoder signal having said first state conditioning said control means to be responsive to said first sensing means and nonresponsive to said second sensing means to control the speed of the spindle to set the peripheral speed of the rotating blank supported by the spindle to be substantially equal to the peripheral speed of the first tool as sensed by said first sensing means, said encoder means when establishing an encoder signal having said second state conditioning said control means to be responsive to said second sensing means and nonresponsive to said first sensing means to control the speed of the spindle to set the peripheral speed of the rotating blank supported by the spindle to be substantially equal to the peripheral speed of the second tool as sensed by said second sensing means.

4. An apparatus for manufacturing split pulleys as defined in claim 3 further including scaler means for scaling said first and second signals indicative of the speed of rotation of said first and second tools, respectively, to enable said control means to control the speed of the spindle to maintain the peripheral speed between the tools and the blank supported by the spindle to be substantially equal upon initial engagement between the blank and the respective tool to prevent skidding of the tools relative to the blank for various tools and blanks of various configurations.

5. An apparatus for manufacturing split pulleys as defined in claim 3 wherein said second and third motor means are deenergized subsequent to initial engagement between said rotating blank supported by said spindle and said first and second tools, respectively, to prevent a mismatch of peripheral speeds between the blanks and said tools due to the decrease in radial distance that the engaged peripheral edge of the blank is disposed from the axis of rotation of the rotating blank as the engaged tool penetrates the blank.

6. An apparatus for manufacturing split pulleys comprising a spindle for rotatably supporting a blank to be split, first motor means connected with said spindle for effecting rotation of said spindle and a blank supported therein, a rotatable splitting tool disposed adjacent said spindle and having an axis of rotation parallel to the axis of rotation of said spindle, said splitting tool being movable relative to said spindle for effecting engagement of said splitting tool with the peripheral edge of a blank supported by said spindle to split the peripheral edge of the blank into two divergent flanges, second motor means for effecting rotation of said splitting tool prior to engagement with said peripheral edge of the blank, a rotatable forming tool disposed adjacent said spindle and having an axis of rotation parallel to the axis of rotation of said spindle, said forming tool being movable relative to said spindle for effecting engagement of said forming tool with the peripheral edge of a blank supported by said spindle to shape the groove formed in the peripheral edge of the blank by said splitting tool, third motor means for effecting rotation of said forming tool prior to engagement therewith with said peripheral edge of the blank, and control means for controlling the energization of said first motor means to control the speed of said spindle to match the peripheral speed of a blank supported by said spindle with the peripheral speed of the splitting tool during initial engagement of said splitting tool with the rotating blank, said control means further controlling the speed of said spindle to match the peripheral speed of a blank supported by said spindle with the peripheral speed of the forming tool during initial engagement of said forming tool with the rotating blank.

7. An apparatus for manufacturing split pulleys as defined in claim 6 wherein said apparatus operates in a cyclic fashion to effect manufacture of successive split pulleys and further including encoder means for sensing the instantaneous position in the cycle of operation of the apparatus for establishing an encoder signal indicative of the instantaneous position of operation in the cycle of the apparatus and wherein said encoder signal controls said control means to determine whether the spindle speed should be controlled to match the peripheral speed of a blank rotated by the spindle with the peripheral speed of the splitting tool or the peripheral speed of the forming tool depending upon the instantaneous position in the cycle of operation of the apparatus.

8. An apparatus for manufacturing split pulleys as defined in claim 6 further including an encoder means for establishing an encoder signal having first and second states, said encoder means when establishing an encoder signal having said first state conditioning said control means to control the speed of the spindle to set the peripheral speed of the rotating blank supported by the spindle to be substantially equal to the peripheral speed of the splitting tool, said encoder means when establishing an encoder signal having said second state conditioning said control means to control the speed of the spindle to set the peripheral speed of the rotating blank supported by the spindle to be substantially equal to the peripheral speed of the forming tool.

9. An apparatus for manufacturing split pulleys as defined in claim 8 wherein said second and third motor means are deenergized immediately subsequent to initial engagement between said rotating blank supported by said spindle and said splitting and forming tools, respectively, to allow said splitting and forming tools to be driven by the edge contact between the peripheral edge of said rotating blank and the respective tools, said deenergization of said second and third motors immediately subsequent to initial engagement between said tools and said blank preventing a mismatch of peripheral speeds between the blank and the tool engaged therewith upon penetration of the peripheral edge of the blank by the tool engaged therewith and the corresponding decrease in radial distance that the engaged peripheral edge of the blank if disposed from the axis of rotation of the rotating blank.

10. An apparatus for manufacturing split pulleys as defined in claim 9 further including first sensing means for establishing a first signal indicative of the speed of rotation of said splitting tool, and second sensing means for establishing a second signal indicative of the speed of rotation of said forming tool, said first and second sensing means directing said first and second signals to said control means to enable said control means to sequentially control the speed of a blank supported by said spindle to match the peripheral speed of the blank first with the peripheral speed of said splitting tool as indicated by said first signal and then with the peripheral speed of said forming tool as indicated by said second signal.

11. An apparatus for manufacturing split pulleys comprising a spindle for rotatably supporting a blank to be split, first motor means connected with said spindle for effecting rotation of said spindle and a blank supported therein, a rotatable tool disposed adjacent said spindle and having an axis of rotation parallel to the axis of rotation of said spindle, said tool being movable relative to said spindle for effecting engagement of said first tool with the peripheral edge of a blank supported by said spindle to split the peripheral edge of the blank into two divergent flanges, second motor means for effecting rotation of said first tool prior to engagement with said peripheral edge of the blank, sensing means for establishing a signal indicative of the speed of rotation of said tool, and control means responsive to said signal for controlling the energization of said first motor means to control the speed of said spindle, said control means controlling the speed of said spindle to match the peripheral speed of a blank supported by said spindle with the peripheral speed of the tool during initial engagement of said tool with the rotating blank.

12. An apparatus for manufacturing split pulleys as defined in claim 11 wherein said second motor means is deenergized subsequent to initial engagement between said rotating blank supported by said spindle and said tool, to prevent a mismatch of peripheral speeds between the blank and said tool due to the decrease in radial distance that the engaged peripheral edge of the blank is disposed from the axis of rotation of the rotating blank as the engaged tool penetrates the blank.

13. An apparatus for manufacturing split pulleys as defined in claim 12 further including scaler means for scaling said signal indicative of the speed of rotation of said tool, to enable said control means to control the speed of the spindle to maintain the peripheral speed between the tool and the blank supported by the spindle to be substantially equal upon initial engagement between the blank and the tool to prevent skidding of the tool relative to the blank for various tools and blanks of various configurations.

* * * * *